US006640076B2

(12) United States Patent
Shintani

(10) Patent No.: US 6,640,076 B2
(45) Date of Patent: Oct. 28, 2003

(54) DEVELOPING ROLLER HAVING DEVELOPING SLEEVE INCLUDING PORTIONS WITH DIFFERENT TRANSPORTATION CAPACITIES

(75) Inventor: Takeshi Shintani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/998,316

(22) Filed: Dec. 3, 2001

(65) Prior Publication Data

US 2002/0067933 A1 Jun. 6, 2002

(30) Foreign Application Priority Data

Dec. 1, 2000 (JP) ..... 2000-366614
Nov. 16, 2001 (JP) ..... 2001-351536

(51) Int. Cl.[7] ..... G03G 15/08; G03G 15/09
(52) U.S. Cl. ..... 399/276; 399/103
(58) Field of Search ..... 399/103, 104, 399/274, 275, 276

(56) References Cited

U.S. PATENT DOCUMENTS

| | | | | |
|---|---|---|---|---|
| 4,380,966 A | * | 4/1983 | Isaka et al. | 399/276 X |
| 4,597,661 A | * | 7/1986 | Yamashita | 399/276 |
| 4,733,267 A | * | 3/1988 | Enoki et al. | 399/276 X |
| 5,084,733 A | * | 1/1992 | Katoh et al. | 399/104 |
| 5,202,729 A | * | 4/1993 | Miyamoto et al. | 399/103 |
| 5,220,383 A | | 6/1993 | Enoki et al. | |
| 5,227,842 A | | 7/1993 | Hayashi et al. | |
| 5,239,344 A | | 8/1993 | Enoki et al. | |
| 5,245,391 A | | 9/1993 | Suzuki et al. | |
| 5,270,783 A | | 12/1993 | Bisaiji et al. | |
| 5,311,263 A | | 5/1994 | Suzuki et al. | |
| 5,347,347 A | * | 9/1994 | Hilbert et al. | 399/276 X |
| 5,384,628 A | | 1/1995 | Takami et al. | |
| 5,389,733 A | | 2/1995 | Enoki et al. | |
| 5,508,794 A | | 4/1996 | Ikesue et al. | |
| 5,519,472 A | * | 5/1996 | Ojima et al. | 399/274 |
| 5,608,502 A | * | 3/1997 | Yamashita et al. | 399/276 |
| 5,627,630 A | | 5/1997 | Matsumae et al. | |
| 5,671,470 A | | 9/1997 | Maruta et al. | |
| 5,724,634 A | | 3/1998 | Maruta | |
| 5,819,145 A | | 10/1998 | Tanaka et al. | |
| 5,826,146 A | | 10/1998 | Maruta et al. | |
| 5,835,825 A | | 11/1998 | Maruta | |
| 5,860,038 A | | 1/1999 | Kato et al. | |
| 5,881,334 A | | 3/1999 | Maruta et al. | |
| 6,009,293 A | | 12/1999 | Takami | 399/227 |
| 6,055,386 A | | 4/2000 | Kato et al. | |
| 6,081,378 A | | 6/2000 | Romano et al. | 399/49 |
| 6,122,469 A | | 9/2000 | Miura et al. | 399/227 |
| 6,160,569 A | | 12/2000 | Fujimori et al. | |
| 6,226,481 B1 | | 5/2001 | Yoneda et al. | |

FOREIGN PATENT DOCUMENTS

| | | |
|---|---|---|
| JP | 63-98675 | * 4/1988 |
| JP | 8-328376 | * 12/1996 |
| JP | 9-146372 | 6/1997 |
| JP | 9-265238 | 10/1997 |
| JP | 10-26861 | 1/1998 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

A developing roller system used in a developing device. A magnet roller includes a plurality of magnets configured to attract the developer. A developing sleeve is provided outside of the magnet roller and configured to carry and convey a developer while bearing the developer by a magnetic force of the magnet roller. The surface of the developing sleeve is configured such that a transportation capacity of the developer in end portions of the developing sleeve which correspond to a vicinity of ends of the magnet roller is smaller than the transportation capacity of the developer in a central portion of the developing sleeve which corresponds to a central portion of the magnet roller. The developer includes a two-component developer having a toner and a carrier.

14 Claims, 8 Drawing Sheets

DEVELOPING ROLLER HAVING DEVELOPING SLEEVE INCLUDING PORTIONS WITH DIFFERENT TRANSPORTATION CAPACITIES

CROSS REFERENCE TO RELATED APPLICATIONS

This document claims priority and contains subject matter related to Japanese Patent Application No. 2000-366614, filed on Dec. 1, 2000, and Japanese Patent Application No. 2001-351536, filed on Nov. 16, 2001, and the entire contents thereof are herein incorporated by reference.

BACKGROUND OF THE INVENTION

1. Field of the Invention

The present invention relates to a developing roller in a developing device to be used in an image forming apparatus, such as a copying machine, a facsimile and a printer. More particularly, the invention relates to a developing sleeve wherein an amount of a developer on a surface of the developing sleeve is uniform without imposing a stress on the developer by a regulating member.

2. Discussion of the Background

A developing roller in a developing device used in an image forming apparatus, such as a copying machine, a facsimile, a printer, and so forth generally includes a developing sleeve and a magnet. A developer is carried on a surface of the developing sleeve and conveyed to develop a latent image formed on a surface of a photoconductive element into a visible image. If an amount of the developer on the surface of the developing sleeve is not uniform, the developed visible image has an uneven image density, resulting in a degradation of a produced image. Therefore, it is preferable that the amount of the developer on the surface of the developing sleeve is uniform. In order to keep the amount of the developer on the surface of the developing sleeve uniform, a regulating member, which is referred to as a doctor, is generally employed.

The amount of the developer in end portions of the developing sleeve is increased compared to that of the developer in a central portion of the developing sleeve because of a wraparound magnetic force generated by an end portion of a magnet. Thus, the amount of the developer is locally increased in the vicinity of the end portion of the magnet, resulting in a coagulation of the developer on the surface of the developing sleeve due to a stress imposed on the developer.

In Japanese Patent Laid-Open Publication No. 9-265238, a technology for reducing an amount of a developer in the vicinity of a magnet by changing a magnetic force exerted on the doctor or a shape of the doctor to increase a regulating force of the doctor. In the above-described technology, the developer which passes the doctor undergoes a stress. Thus, a strain results on the developer. The developer which undergoes the stress tends to move to a portion of the developing sleeve where a reduced stress is imposed on the developer.

If there is strain on the developer, a property of the developer may change, resulting in an early deterioration of the developer. In addition, when the developer moves to the portion of the developing sleeve where a reduced stress is imposed on the developer, an amount of the developer increases locally at this portion of the developing sleeve, resulting in the coagulation of the developer. In addition, the developer scatters when the developer undergoes a stress imposed by the regulating member.

SUMMARY OF THE INVENTION

The present invention has been made in view of the above-mentioned and other problems and addresses the above-discussed and other problems.

The present invention advantageously provides a novel developing roller, developing device using the developing roller, and image forming apparatus using the developing device, wherein a developer on a developing sleeve is uniformed without imposing a stress on the developer by a regulating member, thereby a coagulation of the developer on the developing sleeve is prevented. In addition, a scattering of the developer, an early deterioration of the developer, and a deterioration of a sealing member by the developing sleeve are prevented.

According to an example of the present invention, the developing roller includes a magnet roller including a plurality of magnets configured to attract the developer, and a developing sleeve provided outside of the magnet roller and configured to carry and convey the developer while bearing the developer by a magnetic force of the magnet roller. The surface of the developing sleeve is configured such that a transportation capacity of the developer in end portions of the developing sleeve which correspond to a vicinity of ends of the magnet roller is smaller than the transportation capacity of the developer in a central portion of the developing sleeve which corresponds to a central portion of the magnet roller.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
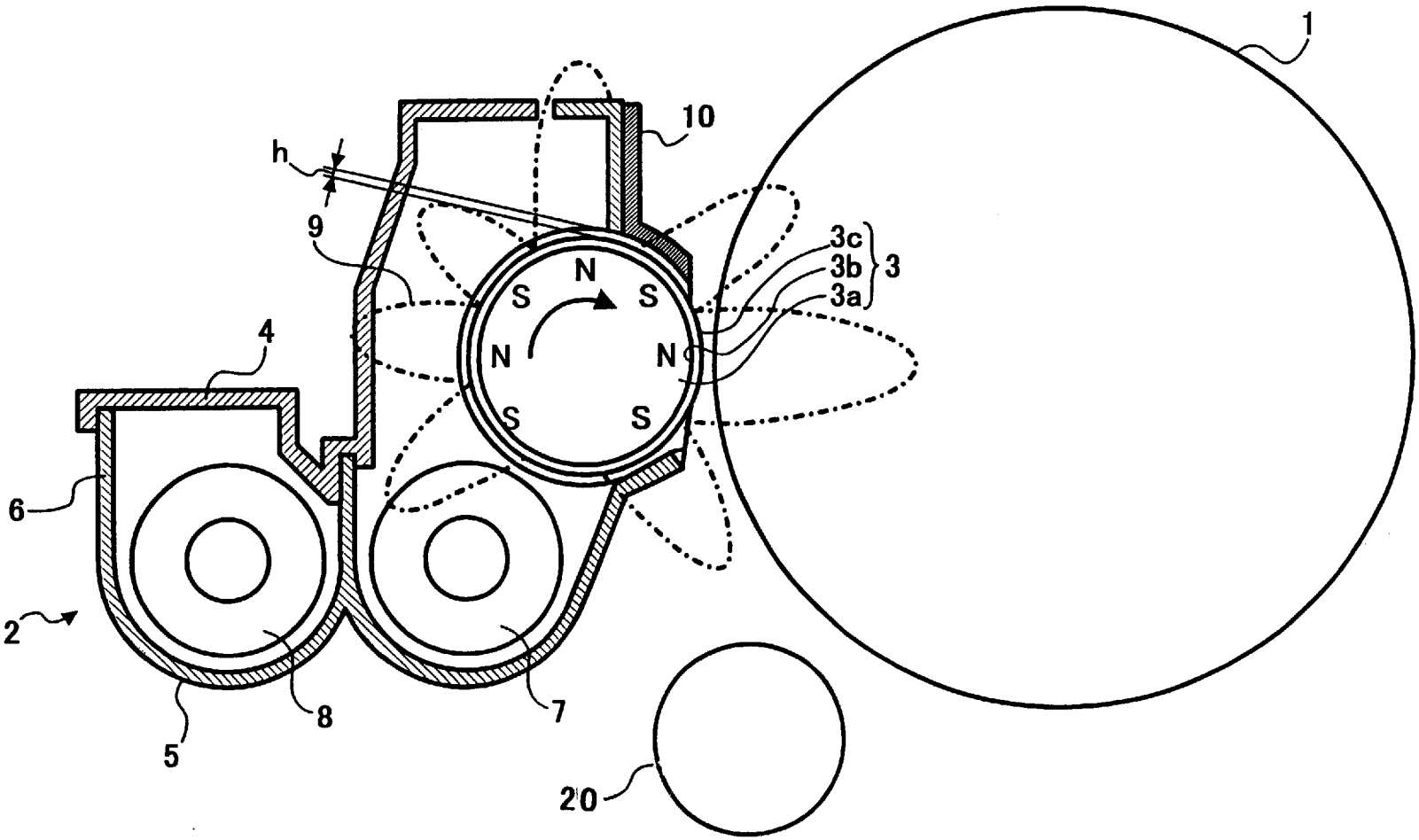
FIG. 1 is a schematic drawing illustrating an alternate embodiment of a developing device of an image forming apparatus according to a first example of the present invention.

Referring now to the drawings, wherein like reference numerals designate identical or corresponding parts throughout the several views, FIG. 1 is a schematic drawing illustrating an alternate embodiment of a developing device of an image forming apparatus according to the present invention. In an image forming apparatus in which the developing device is used, a photoconductive drum 1 is an image bearing member which is rotatably driven by a driving device (not shown) when an image is formed. The photoconductive drum 1 is then uniformly charged by a charging device (not shown). Thus, a surface of the photoconductive drum 1 is exposed to a beam light emitted from an exposure device (e.g., a writing device) to form an electrostatic latent image thereon. A developing device 2 develops the electrostatic latent image formed on the surface of the photoconductive drum 1 into a visible image with toner (i.e., a toner image). The toner image is transferred onto a transfer sheet, which is fed by a feeding device 20, by a transfer device (not shown).

The toner image transferred onto the transfer sheet is fixed by a fixing device (not shown). The transfer sheet is then discharged to outside the apparatus. The photoconductive drum 1 is cleaned by a cleaning device (not shown) after the toner image is transferred onto the transfer sheet. The above-described image forming operation is continuously repeated until the set number of prints is completed. A belt-type photoconductive element may be employed instead of the photoconductive drum 1.

In the developing device 2, a developing roller 3 (i.e., a developer bearing member) is provided in a developer container 6 at a position opposed to the photoconductive element 1 through an inlet of the developer container 6. The developer container 6 includes an upper case 3 and a lower case 4. End portions of the developing rollers 3 are rotatably supported by end portions of the developer container 6. Conveying screws 7 and 8 (i.e., an agitation device) are provided in the developer container 6. End portions of conveying screws 7 and 8 are rotatably supported by end portions of the developer container 6. Conveying screws 7 and 8 are rotatably driven by a driving source (not shown). Conveying screws 7 and 8 circulate a developer (e.g., a two-component developer including toner and a magnetic carrier) in the developer container 6 while agitating the developer and conveying it to the developing roller 3.

The developing roller 3 includes a magnet roller **3*b* and a developing sleeve 3*c*. The magnet roller 3*b* includes a plurality of magnets 3*a* inside. The developing sleeve 3*c* is provided outside of the magnet roller 3*b* to carry and convey a developer. The magnet roller 3*b* is fixedly provided. The developing sleeve 3*c* is rotatably driven by a driving source (not shown) in a direction indicated by an arrow in FIG. 1. The developer adheres to a surface of the developer sleeve 3*c* by a magnetic force 9 of the plurality of magnets 3*a* to form a magnetic brush. The magnetic brush is supplied to a developing region formed between the photoconductive drum 1 and the developing sleeve 3*c***.

The developer unevenly adheres to the surface of the developing sleeve **3*c*. Thus, a regulating member 10 (which is referred to as a doctor) is provided to a position above the circumferential surface of the developing sleeve 3*c* while creating a clearance "h" of a predetermined amount between the circumferential surface of the developing sleeve 3*c* and the regulating member 10. The regulating member 10 regulates an amount of the developer on the surface of the developer sleeve 3*c* so that an even amount of the developer is supplied to the developing region. Although the non-magnetic regulating member is employed to simplify a construction of the developing device 2**, a magnetic regulating member or a regulating member including a non-magnetic regulating member and a magnetic board may be employed.

Figure 2:
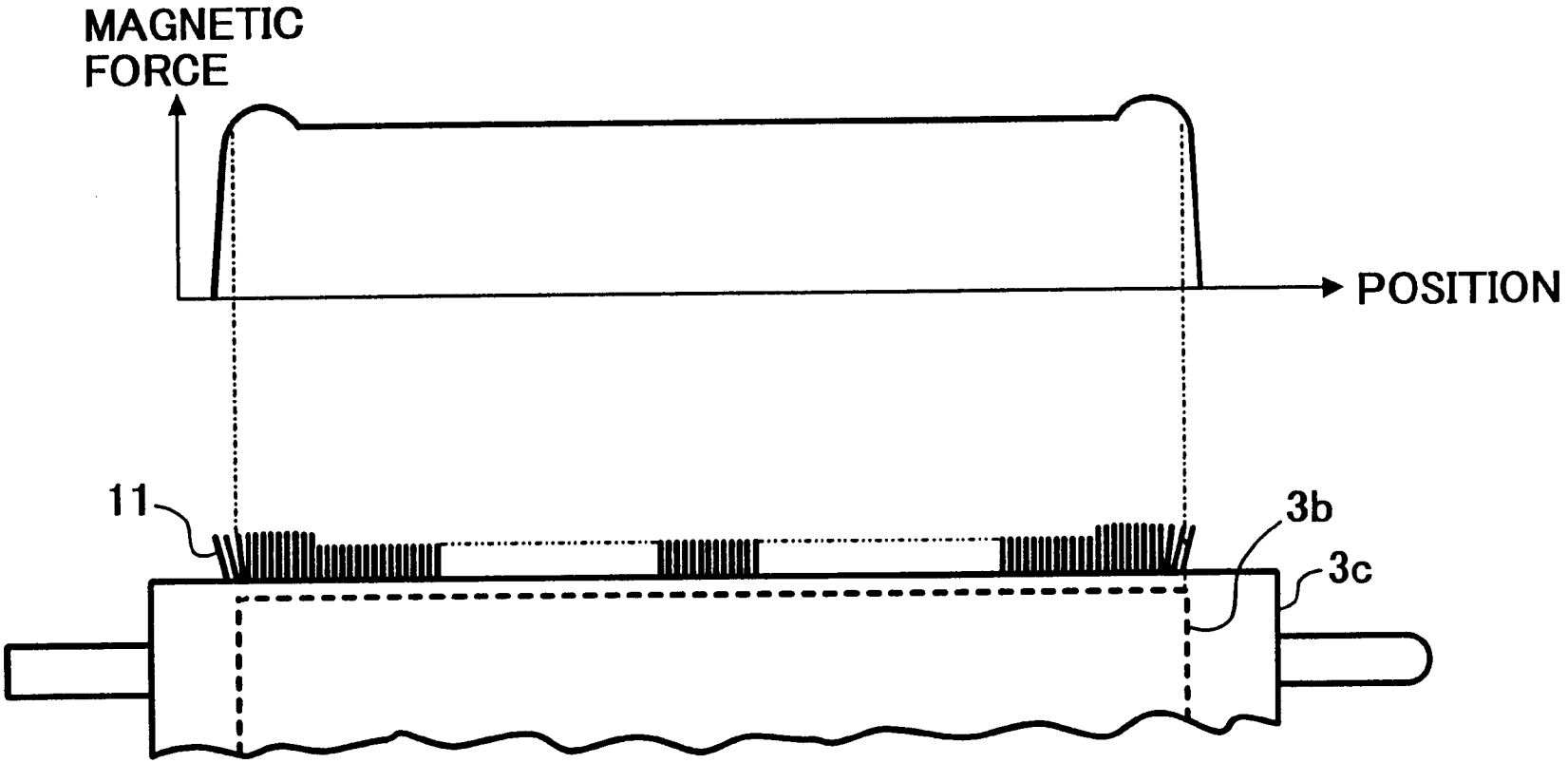
FIG. 2 is a diagram illustrating a relationship of the magnetic force to an amount of a developer on a developing sleeve.

Even though the amount of the clearance "h" between the developing sleeve **3*c* and the regulation member 10 is uniformly created in a longitudinal direction, an amount of a developer 11 (i.e., magnetic brush) on the surface of the developing sleeve 3*c* is increased based on a location of the developer 11. For example, the amount of developer 11 located close to ends of the magnet roller 3*b* is largest in regions adjacent to the ends of the magnet roller 3*b*, as illustrated in FIG. 2**.

The above-described varying amounts of developer at the locations occur based on a line of magnetic force of the magnet **3*a*. For example, as illustrated in FIG. 2, the magnetic force, at a portion of the magnet 3*a* which is loated at immediate upstream side of the regulating member 10, is larger at an edge of the magnet 3*a*, in a normal direction. A relationship between the magnetic force and the amount of the developer on the surface of the developing sleeve 3*c* is described below. The relationship is identical to each magnet of the plurality of magnets 3*a*. Thus, the description is made based on the relationship between the magnetic force of one magnet and the amount of the developer on the surface of the developing sleeve 3*c***.

Figure 3A:
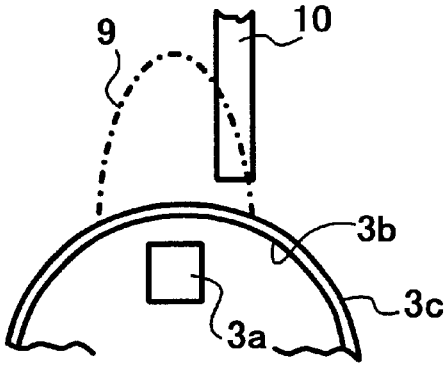
FIGS. 3A and 3B are diagrams illustrating the magnetic force in a normal direction.
Figure 3B:
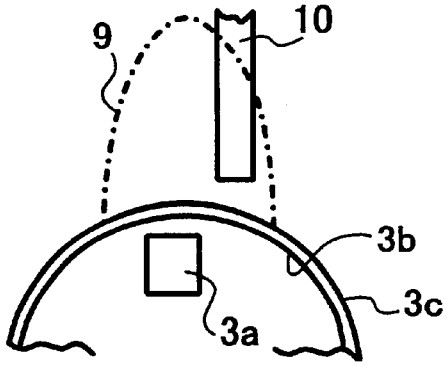
Figure 3C:
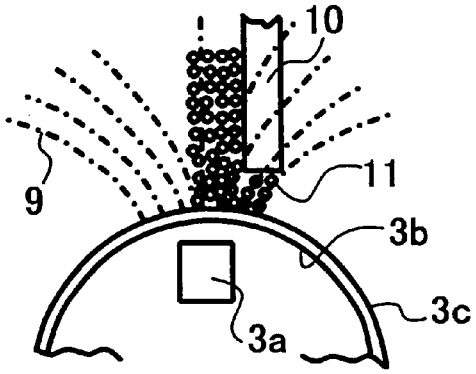
FIGS. 3C and 3D are diagrams illustrating the magnetic force in the normal direction and the developer on the developing sleeve.
Figure 3D:
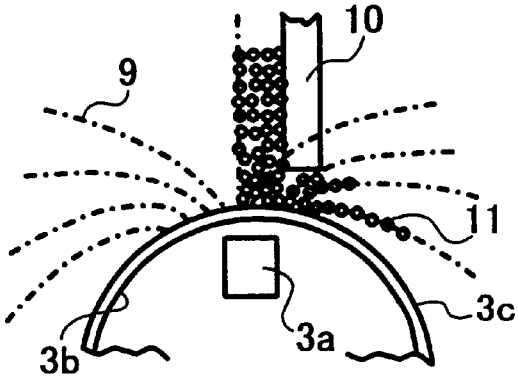

FIG. 3A is a diagram illustrating the magnetic force 9 of the magnet **3*a* in the normal direction disposed in a central portion of the magnet roller 3*b*. FIG. 3B is a diagram illustrating the magnetic force 9 of the magnet 3*a* in the normal direction disposed in ends of the magnet roller 3*b*. FIG. 3C is a diagram illustrating the magnetic force 9 of the magnet 3*a* in the normal direction disposed in the central portion of the magnet roller 3*b*, and the developer 11 on the developing sleeve 3*c*. FIG. 3D is a diagram illustrating the magnetic force 9 of the magnet 3*a* in the normal direction disposed in the ends of the magnet roller 3*b*, and the developer 11 on the developing sleeve 3*c*. As described above, the magnetic force 9 of the magnet 3*a* in the normal direction disposed in ends of the magnet roller 3*b* differs from that of the magnet 3*a* in the normal direction disposed in the central portion of the magnet roller 3*b*. The larger the magnetic force 9 in the normal direction, the larger the magnetic force 9 in a tangent line direction. The magnetic force 9 in the tangent line direction produces an effect of inclining the magnetic brush 11 toward a surface side of the developing sleeve 3*c*. An amount of a developer that passes the regulating member 10 is increased when the magnetic brush 11 passes the regulating member 10, while the magnetic brush 11 on the developing sleeve 3*c* is inclined toward the surface side of the developing sleeve 3*c* compared to a case where the magnetic brush 11 on the developing sleeve 3*c* passes the regulating member 10** in an upright posture.

As described above, the magnetic force 9 in the normal direction at ends of the magnet roller **3*b* is larger than that in the central portion thereof due to an effect of a wrap-around magnetic force. Thus, the magnetic force 9 in the tangent line direction at ends of the magnet roller 3*b* becomes larger than that in the central portion thereof. Because the magnetic force 9 in the tangent line direction has the effect of inclining the magnetic brush 11 toward the surface side of the developing sleeve 3*c*, an increased amount of a developer passes the regulating member 10 at ends of the magnet roller 3*b* compared to the amount of the developer that passes the regulating member 10 in the central portion of the magnet roller 3*b*, even if the clearance "h" between the developing sleeve 3*c* and the regulating member 10 is uniformly created in the direction of the length. Due to the above-described effects, the amount of the developer in end portions of the surface of the developing sleeve 3*c*** is larger than that in the central portion thereof.

Figure 4A:
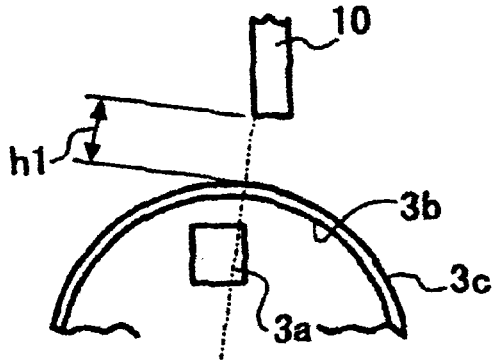
FIG. 4A PRIOR ART
FIGS. 4A, 4B, 4C, and 4D are diagrams illustrating a developing sleeve and a regulating member in a background art.
Figure 4B:
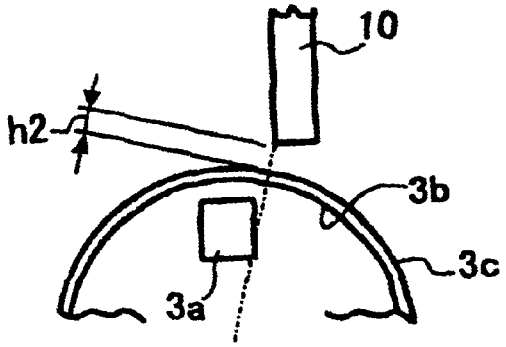
FIG. 4B PRIOR ART
Figure 4C:
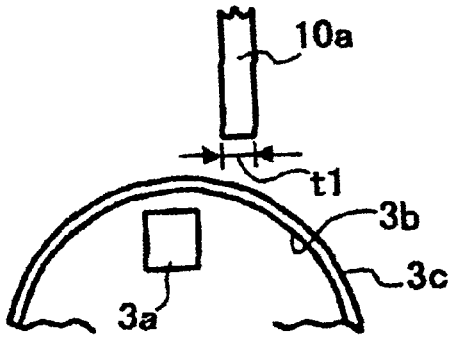
FIG. 4C PRIOR ART
Figure 4D:
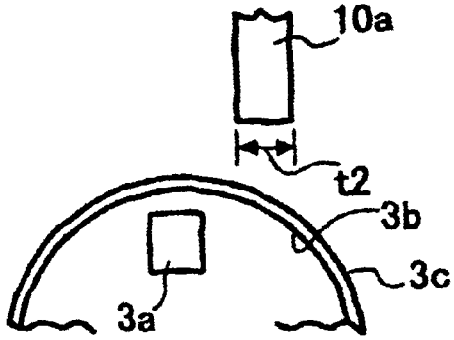
FIG. 4D PRIOR ART

To prevent the above-described variation in developer at the surface, several attempts have been made to achieve the same amount of a developer in both end and central portions of the magnet roller 3*b*. For example, as illustrated in FIGS. 4A and 4B, an amount of a clearance "h2" at ends of the magnet roller 3*b* is decreased without changing an amount of a clearance "h1" in the central portion of the magnet roller 3*b*. For further example, as illustrated in FIGS. 4C and 4D, when a magnetic regulating member 10*a* is employed, a thickness of the magnetic regulating member 10*a* is made larger in an end portions of the magnetic regulating member 10*a* (i.e., "t2") without changing the thickness of the magnetic regulating member 10*a* in a central portion thereof (i.e., "t1").

However, in this case, a developer in end portions of the developing sleeve 3*c* undergoes an increased stress in the vicinity of the regulating member compared to the stress of the developer in the central portion of the developing sleeve 3*c*. Thus, a strain occurs in the developer, resulting in an early deterioration of the developer.

Figure 5:
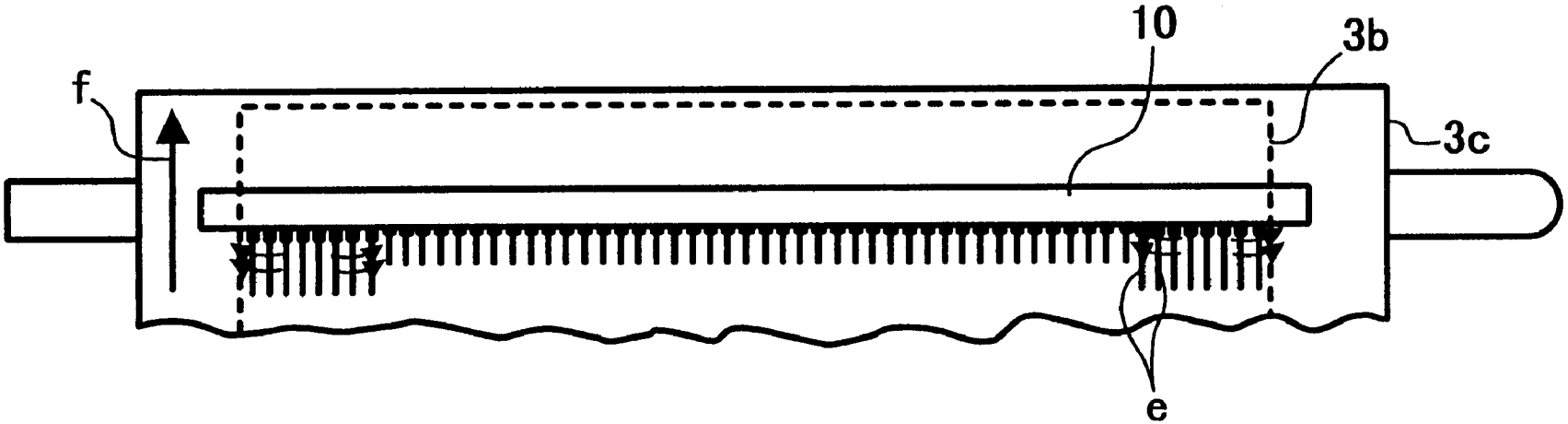
FIG. 5 is a diagram illustrating a force exerted on the regulating member and a movement of the developer.

As illustrated in FIG. 5, because the developer at ends of the magnet roller 3*b*, where the developer undergoes the increased stress, moves to the central portion of the magnet roller 3*b*, where the developer undergoes reduced stress, an amount of the developer locally increases in the vicinity of a boundary between the portion of the regulating member where the regulating force is increased and the portion thereof where the regulating force is not increased. Hence, the developer is coagulated in the vicinity of the boundary. In FIG. 5, an arrow "e" indicates a force exerted on the regulating member 10 and a movement of the developer. An arrow "f" indicates a rotating direction of the developing sleeve 3*c*.

Figure 6:
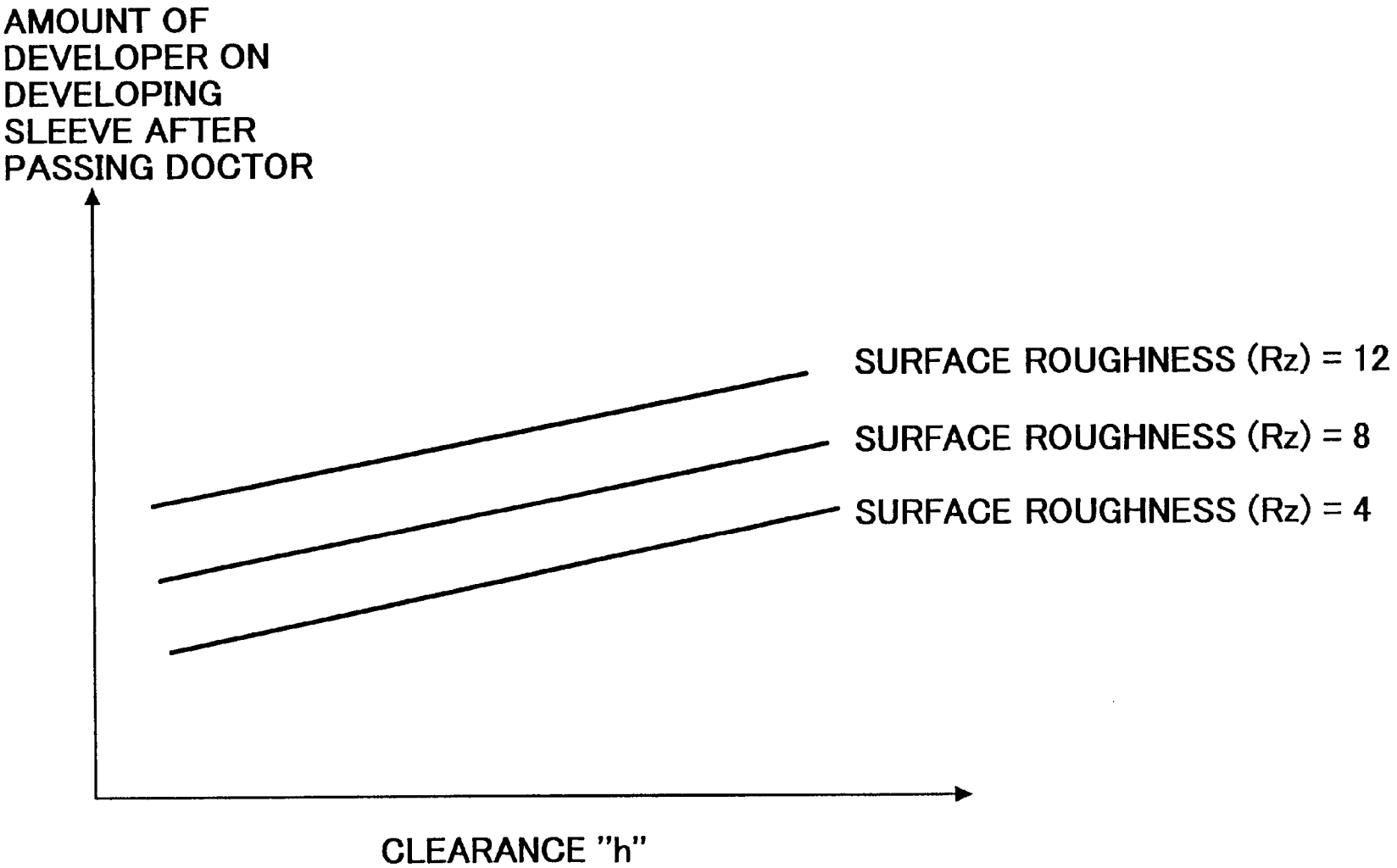
FIG. 6 is a graph illustrating a relationship among an amount of a clearance between the regulating member 10 and the developing sleeve 3*c*, a degree of a surface roughness of the developing sleeve 3*c*, and an amount of the developer 11 adheres to the developing sleeve 3*c;*

A first example of the present invention, in which an amount of a developer in the vicinity of ends of the magnet roller 3*b* is decreased without imposing a stress on the developer, is described below. FIG. 6 is a diagram illustrating a relationship among an amount of the clearance "h" between the regulating member 10 and the developing sleeve 3*c*, a degree of a surface roughness of the developing sleeve 3*c*, and an amount of the developer 11 adheres to the developing sleeve 3*c*. For a given amount of clearance "h", the amount of the developer 11 increases as the surface of the development sleeves 3*c* is made rougher. For a given amount of surface roughness of the developing sleeve 3*c*, the amount of the developer 11 increases as the amount of the clearance "h" is increased.

Figure 7A:
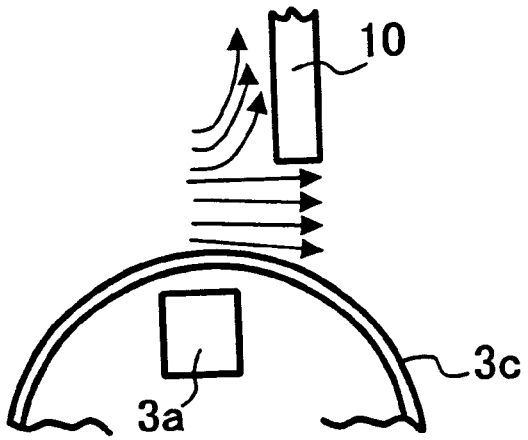
FIGS. 7A and 7B are diagrams illustrating a force in which the developer passes the regulating member.
Figure 7B:
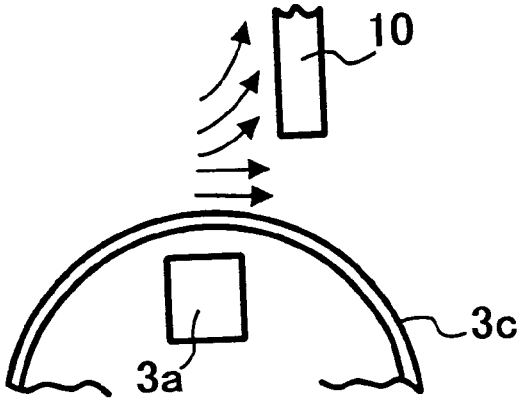

Friction between the developing sleeve 3*c* and developer 11 is increased as the degree of the surface roughness of the developing sleeve 3*c* is increased. Thus, when regulating the amount of the developer 11 by the regulating member 10, a passing force of the developer 11 passing the regulating member 10 is increased, as illustrated in FIG. 7A. To the contrary, the passing force of the developer 11 passing the regulating member 10 is decreased, if the degree of the surface roughness of the developing sleeve 3*c* is decreased, because the friction between the developing sleeve 3*c* and developer 11 is decreased as illustrated in FIG. 7B. Arrows in FIGS. 7A and 7B indicate a moving direction of the developer 11. Thus, the amount of the developer 11 passing the regulating member 10 is increased if the degree of the surface roughness of the developing sleeve 3*c* is increased. To the contrary, the amount of the developer 11 passing the regulating member 11 is decreased if the degree of the surface roughness of the developing sleeve 3*c* is decreased.

An amount of the developer 11 on the surface of the developing sleeve 3*c* corresponding to the vicinity of ends of the magnet roller 3*b* is decreased without imposing a stress on the developer 11 if a degree of a surface roughness of end portions of the developing sleeve 3*c*, which correspond to ends of the magnet roller 3*b*, is decreased compared to the degree of the surface roughness of the central portion thereof, which corresponds to a central portion of the magnet roller 3*b*, and thereby prevents an occurrence of the above-described phenomenon.

Figure 8:
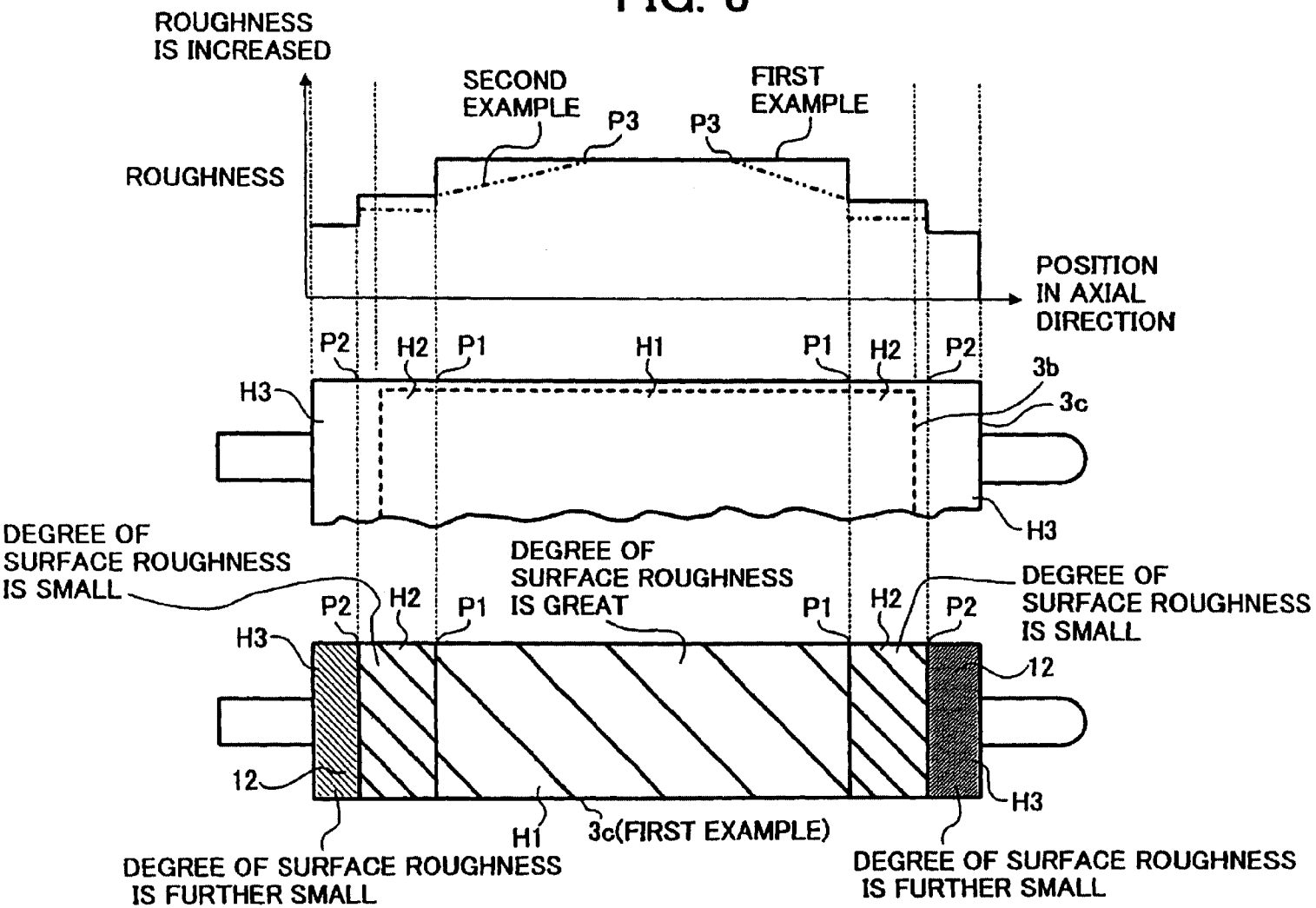
FIG. 8 is a diagram illustrating a surface roughness of the developing sleeve according to the first and a second example of the present invention.

As illustrated in FIG. 8, according to the first example of the present invention, the surface roughness of end portions of the developing sleeve 3*c* (i.e., "H2" which is outside of a position "P1") is decreased compared to that of the central portion thereof (i.e., "H1" which is inside of the position "P1") such that a transportation capacity of the developer 11 of end portions of the developing sleeve 3*c* is smaller than that of the central portion of the developing sleeve 3*c*. Namely, when the surface roughness (Rz) of the central portion of the developing sleeve 3*c* (i.e., "H1") is set to 12 $\mu$m while setting the surface roughness of end portions of the developing sleeve 3*c* (i.e., "H2") to 9 $\mu$m, the amount of the developer 11 on the surface of end portions of the developing sleeve 3*c* is decreased without imposing a stress on the developer 11. The clearance "h" between the developing sleeve 3*c* and the regulating member 10 is uniformly created in the direction of the length.

The developer 11 on the developer sleeve 3*c*, which passed the regulating member 10, moves while spreading over a region of the developing sleeve 3*c* which is outside of ends of the magnet roller 3*b*. Thus, the above-described effect is enhanced if the portion of "H2", in which the transportation capacity of a developer is made smaller, is extended to a position "P2" (see FIG. 8) which is outside of ends of the magnet roller 3*b*.

Generally, a side sealing member 12 is provided to ends of the developing roller 3 to cover end portions of the surface of the developing roller 3. According to the first example of the present invention, the side sealing member 12 is employed. However, the surface roughness of the portions of the developer roller 3, which are covered by the side sealing member 12 (i.e., "H3" in FIG. 8), is decreased, for example, to a value equal to about 4 $\mu$m or less so as not to damage the side seal member. Thus, the value of the surface roughness of the developer roller 3 that does not damage the side sealing member 12 is equal to about 4 $\mu$m or less. In the above-described first example, the surface roughness of the developing sleeve 3*c* between the central portion (i.e., "H1") and end portions (i.e., "H2") thereof changes in one stage.

In a second example of the present invention, the surface roughness of the developing sleeve 3*c* changes in a multi-stage from end portions to the central portion of the developing sleeve 3*c* (i.e., the surface roughness changes continuously linearly between the position "P1" and a predetermined portion "P3") as illustrated in FIG. 8, and produces a similar effect as that of the first example.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A developing roller system used in a developing device comprising:

a magnet roller including a plurality of magnets configured to attract the developer; and a developing sleeve provided outside of the magnet roller and configured to carry and convey a developer while bearing the developer by a magnetic force of the magnet roller, wherein the surface of the developing sleeve is configured such that a transportation capacity of the developer in end portions of the developing sleeve which correspond to a vicinity of ends of the magnet roller is smaller than the transportation capacity of the developer in a central portion of the developing sleeve which corresponds to a central portion of the magnet roller, and wherein the developer comprises a two-component developer including a toner and a carrier.

2. The developing roller system according to claim 1, wherein a degree of a first surface roughness of the end portions of the developing sleeve is decreased compared to a second surface roughness of the central portion of the developing sleeve.

3. The developing roller system according to claim 2, wherein the end portions of the developing sleeve in which the surface roughness is decreased compared to the second surface roughness of the central portion of the developing sleeve are extended to a portion that corresponds to outside of the ends of the magnet roller, and wherein a surface roughness of the portion that corresponds to the outside of the ends of the magnet roller is decreased compared to the first surface roughness of the end portions of the developing sleeve.

4. The developing roller system according to claim 3, wherein a sealing member is provided to ends of the developing sleeve such that a side sealing member covers a part of end portions of the surface of the developing sleeve, and wherein a value of the surface roughness (Rz) of the part of end portions of the surface of the developing sleeve that are covered by the sealing member less than or about equal to 4 $\mu$m or smaller.

5. The developing roller system according to claim 2, wherein a sealing member is provided to ends of the developing sleeve such that a side sealing member covers a part of end portions of the surface of the developing sleeve; and wherein a value of the surface roughness (Rz) of the part of the end portions of the surface of the developing sleeve that are covered by the sealing member is less than or about equal to 4 $\mu$m or smaller.

6. A developing device, comprising:

a conveying screw configured to convey a developer; and a developing roller including, a magnet roller including a plurality of magnets configured to attract the developer; and a developing sleeve provided outside of the magnet roller and configured to carry and convey a developer while bearing the developer by a magnetic force of the magnet roller, wherein the surface of the developing sleeve is configured such that a transportation capacity of the developer in end portions of the developing sleeve which correspond to a vicinity of ends of the magnet roller is smaller than the transportation capacity of the developer in a central portion of the developing sleeve which corresponds to a central portion of the magnet roller, and wherein the developer comprises a two-component developer including a toner and a carrier.

7. An image forming apparatus, comprising:

a transfer sheet feeding device configured to feed a transfer sheet; and a developing device including, a conveying screw configured to convey a developer; and a developing roller including, a magnet roller including a plurality of magnets configured to attract the developer; and a developing sleeve provided outside of the magnet roller and configured to carry and convey a developer while bearing the developer by a magnetic force of the magnet roller, wherein the surface of the developing sleeve is configured such that a transportation capacity of the developer in end portions of the developing sleeve which correspond to a vicinity of ends of the magnet roller is smaller than the transportation capacity of the developer in a central portion of the developing sleeve which corresponds to a central portion of the magnet roller, and wherein the developer comprises a two-component developer including a toner and a carrier.

8. A developing roller system used in a developing device, comprising:

means for providing a magnetic field to attract a developer; and means for carrying and conveying the developer while bearing the developer by a magnetic force of the means for providing the magnetic field, the means for carrying and conveying provided outside of the means for providing the magnetic field, wherein the surface of the means for carrying and conveying is configured such that a transportation capacity of the developer in end portions of the means for carrying and conveying which correspond to a vicinity of ends of the means for providing the magnetic field is smaller than the transportation capacity of the developer in a central portion of the means for carrying and conveying which corresponds to a central portion of the means for providing the magnetic field, and wherein the developer comprises a two-component developer including a toner and a carrier.

9. The developing roller system according to claim 8, wherein a degree of a first surface roughness of the end portions of means for carrying and conveying is decreased compared to a second surface roughness of the central portion of the means for carrying and conveying.

10. The developing roller system according to claim 9, wherein the end portions of the means for carrying and conveying in which the surface roughness is decreased compared to the second surface roughness of the central portion of the means for carrying and conveying are extended to a portion that corresponds to outside of the ends of the means for providing the magnetic field, and wherein a surface roughness of the portion that corresponds to the outside of the ends of the means for providing the magnetic field is decreased compared to the first surface roughness of the end portions of the means for carrying and conveying.

11. The developing roller system according to claim 10, wherein a sealing member is provided to ends of the means for carrying and conveying such that a side sealing member covers a part of end portions of the surface of the means for carrying and conveying, and wherein a value of the surface roughness (Rz) of the part of end portions of the surface of the means for carrying and conveying that are covered by the sealing member is less than or about equal to 4 $\mu$m.

12. The developing roller system according to claim 9, wherein a sealing member is provided to ends of the means for carrying and conveying such that a side sealing member covers a part of end portions of the surface of the means for carrying and conveying; and wherein a value of the surface roughness (Rz) of the part of the end portions of the surface of the means for carrying and conveying that are covered by the sealing member is less than or about equal to 4 $\mu$m.

13. A developing device, comprising:

means for conveying a developer; and means for rolling including, means for providing a magnetic field to attract the developer; and means for carrying and conveying the developer while bearing the developer by a magnetic force of the means for providing the magnetic field, said means for carrying and conveying provided outside of the means for providing the magnetic field, wherein the surface of the means for carrying and conveying is configured such that a transportation capacity of the developer in end portions of the means for carrying and conveying which correspond to a vicinity of ends of the means for providing the magnetic field is smaller than the transportation capacity of the developer in a central portion of the means for carrying and conveying which corresponds to a central portion of the means for providing the magnetic field, and wherein the developer comprises a two-component developer including a toner and a carrier.

14. An image forming apparatus, comprising:

means for feeding a transfer sheet; and means for developing including, a means for conveying a developer; and means for rolling including, means for providing a magnetic field to attract the developer; and means for carrying and conveying the developer while bearing the developer by a magnetic force of the means for providing the magnetic field, the means for carrying and conveying provided outside the means for providing the magnetic field, wherein the surface of the means for carrying and conveying is configured such that a transportation capacity of the developer in end portions of the means for carrying and conveying which correspond to a vicinity of ends of the means for providing the magnetic field is smaller than the transportation capacity of the developer in a central portion of the means for carrying and conveying which corresponds to a central portion of the means for providing the magnetic field, and wherein the developer comprises a two-component developer including a toner and a carrier.

* * * * *